US006350296B1

(12) United States Patent
Warner

(10) Patent No.: US 6,350,296 B1
(45) Date of Patent: Feb. 26, 2002

(54) MAGNETIC DECONTAMINATION DEVICE AND METHOD

(76) Inventor: Clifford Roy Warner, 157 Gills Road, Bucklands Beach, Auckland 1704 (NZ)

( * ) Notice: Subject to any disclaimer, the term of this patent is extended or adjusted under 35 U.S.C. 154(b) by 0 days.

(21) Appl. No.: 09/308,881

(22) PCT Filed: Dec. 1, 1997

(86) PCT No.: PCT/NZ97/00160

§ 371 Date: May 25, 1999

§ 102(e) Date: May 25, 1999

(87) PCT Pub. No.: WO98/24551

PCT Pub. Date: Jun. 11, 1998

(30) Foreign Application Priority Data

Dec. 1, 1996 (NZ) ..... 299203

(51) Int. Cl.[7] ..... B03C 1/30

(52) U.S. Cl. ..... 95/28; 96/1; 210/695; 210/222

(58) Field of Search ..... 210/222, 223, 210/695; 95/28; 96/1

(56) References Cited

U.S. PATENT DOCUMENTS

| | | | | | |
|---|---|---|---|---|---|
| 3,323,647 | A | * | 6/1967 | Ogden et al. | 96/1 X |
| 3,636,864 | A | * | 1/1972 | Losciało | 96/1 X |
| 3,850,811 | A | | 11/1974 | Wheelock | 210/223 |
| 4,254,616 | A | * | 3/1981 | Siminski et al. | 96/1 X |
| 4,261,711 | A | * | 4/1981 | Vaseen | 96/1 |
| 4,370,228 | A | * | 1/1983 | Tashiro et al. | 210/223 |
| 4,440,639 | A | | 4/1984 | Galuska | 210/222 |
| 4,784,767 | A | * | 11/1988 | Hasuda et al. | 210/222 |
| 4,902,428 | A | * | 2/1990 | Cohen | 95/28 X |
| 5,554,209 | A | * | 9/1996 | Dingfelder | 96/1 |

FOREIGN PATENT DOCUMENTS

| | | | | |
|---|---|---|---|---|
| DE | 3342298 | A | 5/1985 | |
| DE | 3808852 | A | 9/1989 | |
| JP | 5-269401 | * | 10/1993 | 95/28 |
| NL | 7414750 | | 5/1976 | |
| NL | 8303970 | | 6/1985 | |
| SU | 722609 | | 4/1980 | |
| SU | 1184565 | A | 10/1985 | |
| SU | 1219143 | A | 3/1986 | |
| SU | 1651964 | | 5/1991 | |
| WO | WO9115302 | | 10/1991 | |

OTHER PUBLICATIONS

*Reference Cited by Applicant in Specification.*

* cited by examiner

*Primary Examiner*—Richard L. Chiesa
(74) *Attorney, Agent, or Firm*—Abelman, Frayne & Schwab

(57) ABSTRACT

A device and method for removing metalliferous particles from a powder so that the powder can be reused. A contaminated powder fluid stream flows down tube (6/7) into zones A, B and C adjacent the surface of a magnet (4). The flow flows past the surface of the magnet (4) and is directed towards the surface of the magnet (4) by baffles (10A, 10B). The magnet (4) separates metallic particles from powder particles and these metallic particles are removed from the face of the magnet (4) by scraper bars (21) conveyed by endless belts (22) supported by roller sets (23). The device can also include a fan (5) for promoting the movement of air in a counter direction to the delivered powder mixture.

21 Claims, 3 Drawing Sheets

FIG. 1
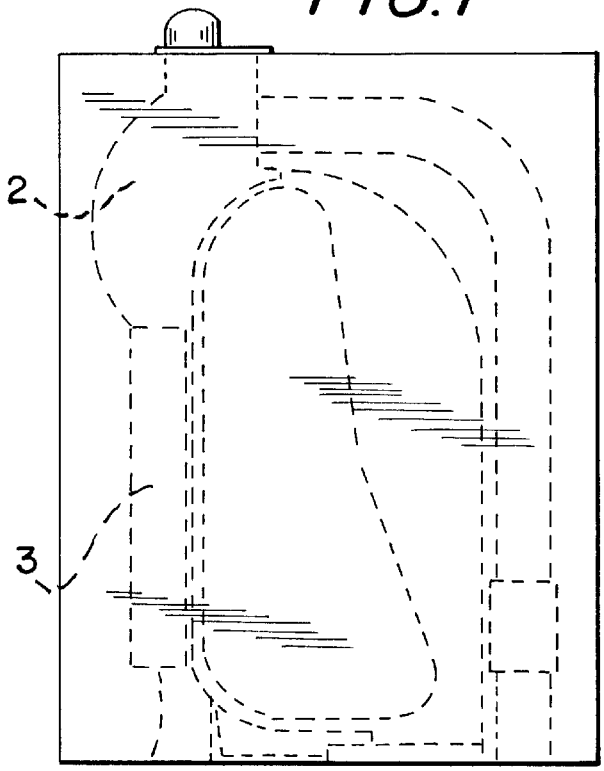
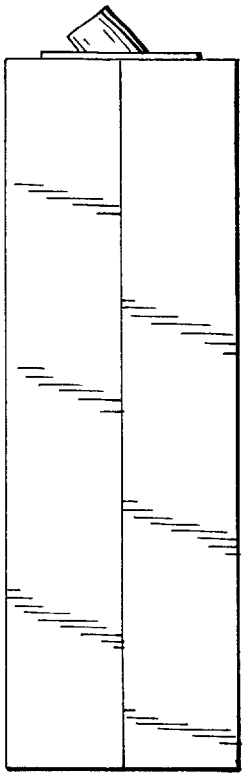
FIG. 2
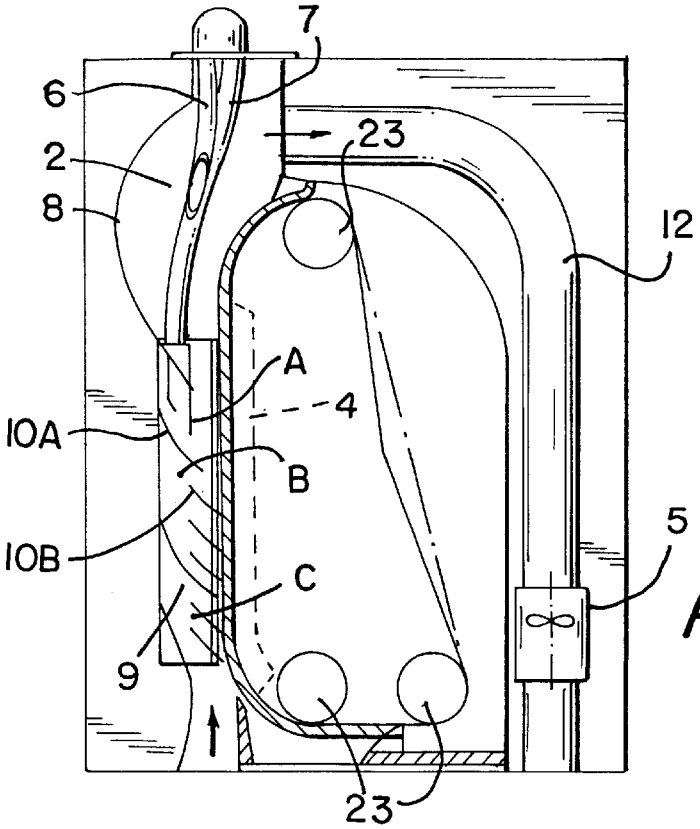
FIG. 3

FIG. 5
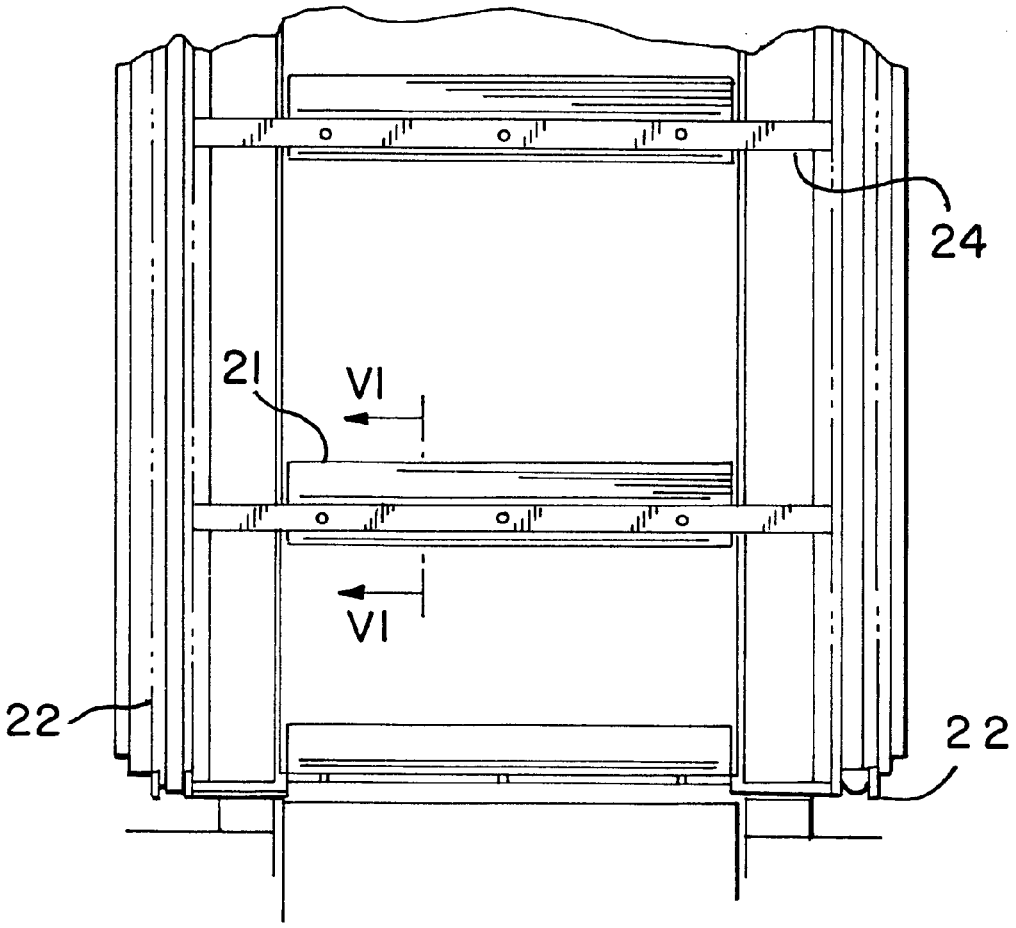
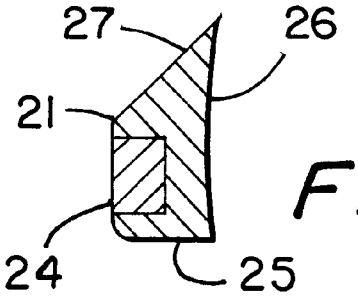
FIG. 6

MAGNETIC DECONTAMINATION DEVICE AND METHOD

This application is the National Stage of International Application No. PCT/NZ97/00160, filed on Dec. 1, 1997.

TECHNICAL FIELD

This invention relates to a decontamination device for removing metalliferous particles from a mixture. In particular, it relates to a decontamination device for removing metalliferous particles from soap-based lubricating powder used in the process of wire extrusion. It should be appreciated however that the present invention is a decontamination device which could be used to remove metalliferous particles from mixtures with many dry fine-grained substances.

BACKGROUND ART

It is increasingly recognised within industry and by the population at large that the disposal of industrial waste products requires a more sophisticated approach. Mere dumping of same, for example in landfills, is simply no longer acceptable in light of current concern for protecting the environment. Quite apart from environmental ramifications, it is also economically desirable to reduce industrial waste as far as practicable.

Often the base component of a contaminated substance has continuing integrity for further industrial application, save that it is contaminated. Where decontamination methods are expensive and time consuming, the substance is simply dumped as waste rather than efforts being made to recycle or re-use the substance.

Wire drawing procedures exhibit significant wastage of lubricant powder. Approximately 90% of all powder used becomes too contaminated for use and is dumped in landfills according to industry sources. The powder becomes contaminated with fine metal particles which ultimately destroy the lubricating capabilities of the powder. Generally, the lubricant powder has a particle size ranging from less than one micron to approximately two millimeters in diameter. The metal particles contaminating the powder comprise either fine slivers and, to a greater extent, fine grain particles of approximately one micron in diameter.

Preliminary investigations suggest that at least some 50 tonnes of contaminated soap based powder lubricant is dumped in landfills in New Zealand alone. Clearly internationally the dumping of contaminated lubricant powder forms a serious environmental problem.

It would be desirable to provide a financially viable and convenient method of removing metal contaminants from mixtures with substances such as lubricant powders to permit re-use of such powders, or any other mixture experiencing contamination by metalliferous particles.

Grate magnets have been used in the past to separate ferrous components from powders. These devices comprise a single magnet or a row of magnets and material is fed through the grate in a single pass operation. Metallic material not attracted to the grate escapes the process.

A number of decontamination devices have been patented in the past. As an example U.S. Pat. No. 4,370,228 discloses a device having an oil storage tank for storing used cutting oil. Magnetic particles contained in the cutting oil are removed by a magnetic conveyor device which is immersed in the oil and particles attracted to the conveyor are continuously removed at a dry zone. The device described in U.S. Pat. No. 4,370,228 is typical of devices in which particulate material is removed from a liquid. It is considered that there are many instances where such methods are not necessary or desirable. New Zealand Patent Nos. 140744 and 116764 describe magnetic separators where "dry" powders contaminated by metal particles are forced to pass rotating or circulating magnets. However, in both instances the efficiency of the separation process appears to be entirely dependent upon the strength of the magnets to a separate metallic particles from powder particles.

It is an object of the present invention to address the foregoing problems or at least to provide the public with a useful alternative.

Further aspects and advantages of the present invention will become apparent from the ensuing description which is given by way of example only.

DISCLOSURE OF INVENTION

According to one aspect of the invention there is provided a device for removing metalliferous particles from a mixture including:

(a) a chamber, (b) means for delivering the powder mixture to the chamber in a fluid stream, (c) a magnet retained within the chamber in proximity to the fluid stream, (d) means for the removal of metalliferous particles attracted to the magnet.

The device can include means for promoting movement of the mixture in a counter direction to the fluid stream.

Said means for promoting movement of the mixture is an airstream which promotes secondary delivery to the magnet of the metalliferous particles not attaching to the magnet from the fluid stream.

The device can include means for separate collection of contaminated and clean particulate material from the powder mixture.

The means for promoting movement of the mixture counter to the fluid stream can be a ducted airflow promoted by a fan.

The airflow can be directed at an acute angle to the fluid stream.

The contaminated mixture can be stored in a container and the material is dispersed to a position adjacent a first face of the magnet.

The device can include a scraping device which continuously wipes the first surface of the magnet.

The device can include a front wall opposite to the first face of the magnet which defines one side of a passage into which the fluid stream is directed.

The dispersal of the mixture into the fluid stream can be metered by a metering device.

The metering device can include an auger.

The scraper can rotate in a direction sympathetic to the fluid stream.

According to a further aspect of the present invention there is provided a method of removing metalliferous particles from a mixture comprising directing contaminated material to a fluid stream within a chamber positioning a magnetic device adjacent an outlet from the fluid stream to attract metalliferous particles thereto.

The method can include means for separate collection of contaminated and clean material from the mixture.

The method can include means for promoting movement of the mixture counter to the fluid stream.

The airflow is directed at an acute angle with respect to the fluid stream.

According to a further aspect of the present invention there is provided a method of removing metalliferous particles from a mixture comprising directing the mixture in a fluid stream at a magnetic surface from a feeding device and providing a controlled turbulent airflow in a direction countering the fluid stream.

BRIEF DESCRIPTION OF DRAWINGS

Further aspects of the present invention will become apparent from the ensuing description which is given by way of example only and with reference to the accompanying drawings in which:

FIGS. 1 & 2 are side and end views of one form of apparatus according to the present invention, and FIG. 3 is a cross-sectional view of the apparatus of FIGS. 1-&-2, FIG. 5 is a view of a scraper device in accordance with one possible embodiment of the present invention, and FIG. 6 is a cross sectional view of a scraper blade and mounting bar for the device of FIG. 5, taken at VI:VI of FIG. 5.

BEST MODES FOR CARRYING OUT THE INVENTION

Figure 4:
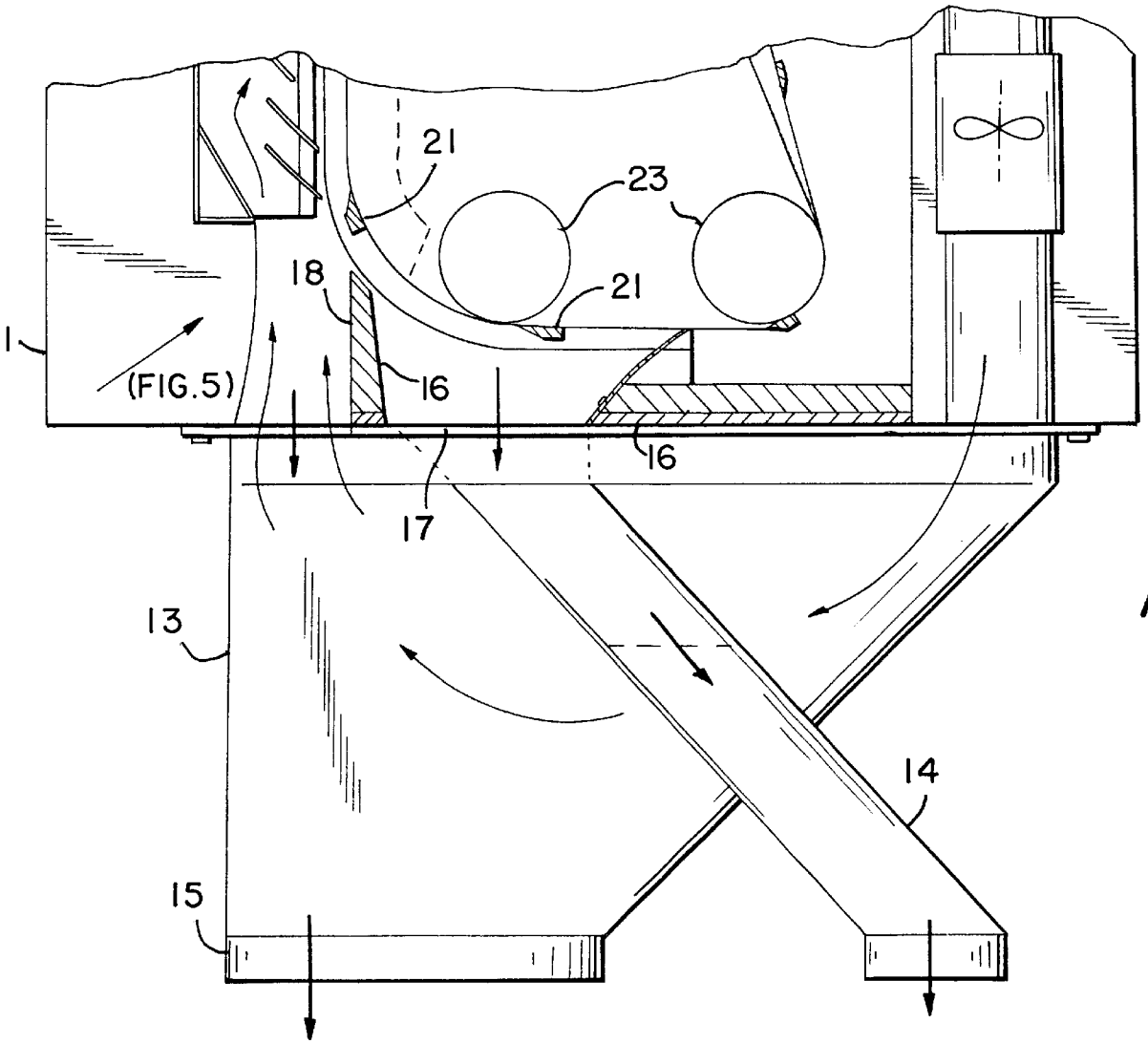
FIG. 4 is a diagrammatic cross-sectional view of the base of the apparatus of FIGS. 1 to 3.

The present invention provides a device for removing ferrous metalliferous particles from a mixture, the device including a chamber generally indicated by arrow 1, means generally indicated by arrow 2 for delivering a powder mixture to the chamber 1 in a fluid stream 3, a magnet 4 adjacent the chamber 1 in the proximity of the fluid stream 3 and means (not shown in FIGS. 1 to 3) for removing metalliferous particles attached to the magnet described herein in relation to the subsequent figures.

The device can also include means such as a fan 5 for promoting the movement of the air in a counter direction to the delivered powder mixture.

The means 2 for delivering the powder mixture to the fluid stream 3 can comprise one or more tubes 6 and 7, and the fluid stream 3 can comprise an upper section 8 and a lower section 9. The upper section 8 provides a space communicable with the lower section 9 with the first tube 6 delivering powder mixture to the section 8 and the second tube 7 delivering powder mixture directly to the lower section 9 of the fluid stream 3. The lower section 9 of the fluid stream has one face open to the magnet 4 and delivery of the metal particles from the powder material to the magnet 4 is enhanced by the provision of a series of baffle plates generally indicated by arrow 10.

The baffle plates divide the fluid stream 3 into three zones A, B and C, whilst the fan 5 directs an airstream to the fluid stream 3 in a direction counter to the direction of delivery of powder mixture to the fluid stream 3 and the airstream combined with the configuration of the baffles in zones A, B and C and maximises the relative constituent shearing action and the agitation of the powder mixture and the separation and attraction of metalliferous particles to the face of the magnet 4.

By the term "relative constituent shearing" is meant the breaking away of a ferrous component (attracted to the magnet) from so-called soap/ferrous particles.

It will be noted that the baffles 10 in zones A, B and C are of different configurations and serve different functions. Baffles 10A are airflow and powder guides, and baffles 10B are powder guides.

The chamber 1 is communicable with a loop 12 which connects via a ducted base generally indicated by arrow 13.

Chamber 1 is provided with a base 13 which has the function of transporting separated clean product and contaminant to receptacles (not shown) and also provides means by which the airstream from fan 5 can be delivered to the fluid stream 3 in a direction counter to the direction of introduction of the powder mixture. The base 13 can be a removable fixture which is bolted to the chamber 1, the base including a contaminant outlet tube 14, a clean product outlet 15. A baffle arrangement generally indicated by arrow 16 provides direction for the airstream from the fan 5, contaminant and clean product as indicated by the path arrows. The baffle includes an opening at 17 and divider 18.

The magnet 4 can be part of a modular magnet assembly generally indicated by 19 which includes a continually revolving scraper mechanism generally indicated by arrow 20 which is best exemplified by FIGS. 5 & 6.

A series of spaced scraper bars 21 are conveyed by belts 22 supported by roller sets 23.

FIG. 4 shows how the scraper bars 21 are conveyed in order to scrape metalliferous particles from the face of the magnet 4 on a continuous basis.

The scraper bars 21 are mounted in a conventional manner to the belts 22 and a cross link 24 supports each scraper 21 and in turn is connected to the belts 22.

Seals 27, 28 & 29 isolate the mechanics of the device from the main stream 3.

FIG. 6 is an enlarged sectional view of a typical scraper blade 21. Each scraper blade 21 comprises a leading face 25, a curved magnet contact face 26 which is radiused to suit the curve of the face of the magnet and a tapered trailing face 27.

The apparatus can include semi-automatic or automatic or programmable control systems which enable it to function continuously and can include an auger device (not shown) feeding contaminated powder to the main stream 3 via tube inlets 6 & 7, means for controlling the conveyance of the scraper mechanism and means for controlling the fan 5.

It will be appreciated that the conveyance of the scrapers may be achieved using a different conveying mechanism from that described and illustrated. One alternative may be to utilise a full width belt conveyor with the scrapers mounted at intervals across the belt.

It will be appreciated that metal particles which are not separated from the powder mixture and miss being attracted to the magnet in a first pass can be recycled through the apparatus.

In this way, metal is conveniently and cost efficiently extracted from powder, thereby enabling contaminated powder to be re-used. This enables industrial users to cut production costs and is of obvious environmental benefit.

Aspects of the present invention have been described by way of example only and it should be appreciated that modifications and additions may be made thereto without departing from the scope thereof as defined in the appended claims.

The claims defining the invention are:

1. A device for removing metalliferous particles from a powder mixture contaminated therewith which comprises:

(a) a chamber, (b) means comprising two tubes for delivering the powder mixture to the chamber in a fluid stream, (c) means for promoting movement of the mixture in a counter direction to the fluid stream, (d) a fixed magnet retained within the chamber in proximity to the fluid stream, (e) a series of baffle plates adjacent the fixed magnet for deflecting the fluid stream towards the fixed magnet, (f) means for the removal of the metalliferous particles attracted to the magnet.

2. A device as claimed in claim 1 wherein said means for delivering the powder mixture to the chamber in a fluid stream is an airstream which promotes secondary delivery to the magnet of the metalliferous particles not attaching to the magnet from the fluid stream.

3. A device as claimed in claim 1 including means for separate collection of contaminated and clean particulate material from the powder mixture.

4. A device as claimed in claim 1 wherein the means for promoting movement of the mixture counter to the fluid stream is a ducted airflow promoted by a fan.

5. A device as claimed in claim 4 wherein the airflow is directed at an acute angle to the fluid stream.

6. A device as claimed in claim 1 wherein the contaminated mixture is stored in a container and the material is dispersed to a position adjacent a first face of the magnet.

7. A device as claimed in claim 6 including a scraping device which continuously wipes the first face of the magnet.

8. A device as claimed in claim 6 including a front wall opposite to the first face of the magnet which defines one side of a passage into which the fluid stream is directed.

9. A device as claimed in claim 6 wherein the dispersal of the mixture into the fluid stream is metered by a metering device.

10. A device as claimed in claim 9 wherein the metering device includes an auger.

11. A device as claimed in claim 7 wherein the scraping device rotates in a direction sympathetic to the fluid stream.

12. A device as claimed in claim 1 wherein the baffle plates are divided into a number of zones which together with the airstream agitates the powder mixture enhancing the separation and attraction of metalliferous particles to the magnet.

13. A method of removing metalliferous particles from a powder mixture contaminated therewith which comprises directing the contaminated material through two tubes to a fluid stream within a chamber, promoting movement of the mixture in a counter direction to the fluid stream, positioning a fixed magnet adjacent an outlet from the fluid stream to attract metalliferous particles thereto, and providing a series of baffle plates adjacent the fixed magnet for deflecting the fluid stream towards the magnet and also providing means for removing the metalliferous particles attracted to the magnet.

14. The method of claim 13 including providing means for separate collection of contaminated and clean material from the mixture.

15. The method of claim 13 wherein the airflow is directed at an acute angle with respect to the fluid stream.

16. The method of claim 13 wherein the contaminated material is initially stored in a container and the material is dispersed adjacent a first face of the magnet.

17. The method of claim 13 including providing a scraping device which continuously wipes the surface of the magnet and delivers particles attracted to the magnet to a collection region.

18. The method of claim 13 including providing a front wall opposite to the magnet which defines one side of a passage into which the fluid stream is directed.

19. The method of claim 13 wherein the dispersal of the particulate material into the fluid stream is metered by a metering device.

20. The method of claim 19 wherein the metering device includes an auger.

21. The method of claim 13 wherein the scraper device rotates in a direction sympathetic to the fluid stream.

* * * * *